US008283297B2

(12) United States Patent
Jin

(10) Patent No.: US 8,283,297 B2
(45) Date of Patent: Oct. 9, 2012

(54) FORMULATION WHICH CREATES PROTECTION LAYERS ON THE METALLIC FRICTION AND WORN SURFACES AND METHOD FOR PREPARING THE SAME

(76) Inventor: Yuansheng Jin, Beijing (CN)

( * ) Notice: Subject to any disclaimer, the term of this patent is extended or adjusted under 35 U.S.C. 154(b) by 667 days.

(21) Appl. No.: 12/297,820

(22) PCT Filed: Mar. 27, 2007

(86) PCT No.: PCT/CN2007/000991

§ 371 (c)(1),
(2), (4) Date: Apr. 7, 2009

(87) PCT Pub. No.: WO2007/121656

PCT Pub. Date: Nov. 1, 2007

(65) Prior Publication Data

US 2010/0173810 A1 Jul. 8, 2010

(30) Foreign Application Priority Data

Apr. 20, 2006 (CN) ..... 2006 1 0075832

(51) Int. Cl.
*C10M 125/26* (2006.01)

(52) U.S. Cl. ..... 508/161; 508/165

(58) Field of Classification Search ..... 508/161, 508/165

See application file for complete search history.

(56) References Cited

U.S. PATENT DOCUMENTS 4,640,943 A * 2/1987 Meguro et al. ..... 523/200

FOREIGN PATENT DOCUMENTS

| | | | |
|---|---|---|---|
| CN | 1391059 A | | 1/2003 |
| CN | 1740290 A | * | 3/2006 |
| CN | 1919954 A | * | 2/2007 |
| RU | 2093719 C1 | | 10/1997 |
| RU | 2169172 C1 | | 6/2001 |
| RU | 2179270 C1 | | 2/2002 |
| WO | WO 0102520 A1 | | 1/2001 |

OTHER PUBLICATIONS

ISR (PCT/CN2007/000991) Jul. 5, 2007.

* cited by examiner

*Primary Examiner* — Jim Goloboy
(74) *Attorney, Agent, or Firm* — Workman Nydegger

(57) ABSTRACT

Provided are a formulation which creates protection layers on the metal friction and wear surface and a method for preparing the same. The formulation provided here comprises 45-99 parts laminar hydroxyl silicate powders, 1-50 parts formulation which creates protection layers on the metal surface and method for preparing the same and 0.05-6 parts carbonization-graphitization catalyst, calculated by weight. Also provided is method for preparing the same. The formulation provided here could create a friction-reducing and wear-resistant nanocrystal protection layer in situ on the metal friction and wear surface, at the same time, it has high hardness of cermet and elastic modulus of formulation which creates protection layers on the metal surface and method for preparing the same high grade alloy steel.

11 Claims, 6 Drawing Sheets

(a)

(b)

(a)

(b)

（H=13.32GPa E=240GPa，H/E=0.0555） a) without protective layer b) with protective layer a) without protective layer b) with protective layer (a) (b)

FORMULATION WHICH CREATES PROTECTION LAYERS ON THE METALLIC FRICTION AND WORN SURFACES AND METHOD FOR PREPARING THE SAME

TECHNICAL FIELD

The present invention relates to a formulation which creates protection layers on metal surface and method for preparing the same.

BACKGROUND ART

It is always a hot spot in scientific field to reduce friction and improve anti-wear property since the reduction of friction loss would lead to stronger mechanical power and higher product efficiency. One of important ways for reducing friction loss and increasing product efficiency is to strengthen and rehabilitate the friction surface and worn surface of machine parts. At present, the friction surface of machine parts generally could be strengthened by the following three approaches: 1) strengthening the surface of parts by pretreatment, including heat treatment strengthening methods such as carburizing, sulfurizing and carbonitriding, film-deposition techniques such as TiN film and DLC film, and mechanical strengthening methods such as shot peening and knurl; 2) surface repairing and regenerating techniques for the worn surface of machine parts, including thermal spraying, brush plating and other surface repairing and regenerating techniques; and 3) in-situ alloying the surfaces of friction pairs by using a lubricant as carrier to convey a formulation with special repairing function into the friction contact regions of machine parts wherein a mechno-chemical reaction (tribo-chemical reaction) among the formulation, the surfaces of friction pairs and third bodies such as wear debris occurs.

The above approaches 1) and 2) are off-line strengthening techniques and have some inherent disadvantages, such as complex procedure, long processing time and high cost. The approach 3) is currently a hot spot in the anti-wear field. However, the currently used products for the approach 3) are not stable in performance and thereby not being widely applied, since the phase structure and mechanical properties of the generated anti-wear layer are still unknown.

CONTENTS OF THE INVENTION

The present invention provides a formulation for generating on a frictional or worn metal surface a protective layer with a high hardness of cermets and an elastic modulus of high quality alloy steel to overcome the drawbacks of methods used in the current anti-wear and repairing fields, such as complex procedure, long processing time and high cost of the methods, as well as unknown phase structure and unstable mechanical performance of the anti-wear and repairing layers generated by the methods. The present invention further provides a method for preparing the formulation.

Some Embodiments of the Present Invention are as Follows:

The present invention provides a formulation for generating a protective layer on a metal surface, comprising the following components in weight parts:

| | |
|---|---|
| Lamellar hydroxyl silicate powder | 45-99; |
| Surface modifier | 1-50; |
| Catalyst for carbonization and graphitization | 0.05-6. |

In a preferred embodiment, the above mentioned formulation comprises the following components in weight parts:

| | |
|---|---|
| Lamellar hydroxyl silicate powder | 60□99; |
| Surface modifier | 3□20; |
| Catalyst for carbonization and graphitization | 0.05-3. |

In a further preferred embodiment, the above mentioned formulation comprises the following components in weight parts:

| | |
|---|---|
| Lamellar hydroxyl silicate powder | 75□99; |
| Surface modifier | 7□12; |
| Catalyst for carbonization and graphitization | 1-2. |

The mentioned lamellar hydroxyl silicate powder is powder of magnesium silicate hydroxide ore.

The mentioned powder of magnesium silicate hydroxide ore is one of the powders of serpentine, talcum, sepiolite and actinolite ore, or a combination thereof.

The mentioned surface modifier is a titanate coupling agent or a silane coupling agent, or a combination thereof.

The mentioned titanate coupling agent is NDZ-131 or NDZ-133 titanate coupling agent.

The mentioned silane coupling agent is HD-22 silane coupling agent.

NDZ-131 and NDZ-133 are two titanate coupling agents produced by Tsingdao Haida Chemistry Co., Ltd, and both are mono-alkoxy fatty-acid titanate coupling agents. HD-22 is a trade name of a silane coupling agent, and is also produced by Tsingdao Haida Chemistry Co., Ltd.

The catalyst for carbonization and graphitization is one of elementary elements, oxides and chlorides of the Group VIIIA elements in the Periodic Table of Elements (Fe, Co, Ni, Ru, Rh, Pd, Os, Ir, Pt), or a combination thereof. The oxides and chlorides of the Group VIIIA elements can be purchased from Shanghai Jiushan Chemistry Co., Ltd.

The formulation for generating a protective layer on a metal surface can be used for repairing and protecting metal surface of an iron-containing material.

The present invention further provides a method for preparing the formulation, comprising the following steps:

1) Grinding a powder of natural magnesium silicate hydroxide ore with a surface modifier to form an oil-dispersible composite powder with particles of nanometer to micrometer grade;
2) Adding a catalyst for carbonization and graphitization and continuously grinding to form a formulation in form of uniform powder.

The present invention also provides a lubricant containing the formulation.

The present invention further provides a method of using the formulation, comprising: directly adding the formulation in form of uniform powder in a mass ratio of 0.1-5‰ to a lubricant.

In a preferred embodiment, the method of using the formulation comprises admixing the formulation in form of uniform powder in a mass ratio of 0.1-5% to a basic lubricant to form a concentrate, and directly adding the concentrate to a lubricant in a proportion of the concentrate: the lubricant=1:9.

The lubricant is a lubricating oil or grease.

The basic lubricant is a colorless and transparent basic oil of trademark 100N or 150N, a lithium-based grease, or a calcium-based grease.

The formulation can be used by the following specific methods:

Method 1), comprising: dissolving the formulation in form of uniform powder in a mass ratio of 0.1-5% into a colorless and transparent basic oil of trademark 100N or 150N to form a concentrate, and directly adding the concentrate to a lubricant in proportion of the concentrate: the lubricant=1:9.

Method 2), comprising: blending the formulation in form of uniform powder in a mass ratio of 0.1-5% with a lithium-based grease or a calcium-based grease and stirring uniformly to form a concentrate, and directly adding the concentrate to a lubricating grease in proportion of the concentrate: the lubricating grease=1:9.

The Technical Effects of the Present Invention are Shown as Follows.

The formulation for generating a protective layer on a frictional and worn metal surface according to the present invention can in-situ form a nanometer crystal layer for anti-friction and wear-resistance on the frictional and worn metal surface, in which the protective layer possesses both a high surface hardness of cermets and an elastic modulus of high quality alloy steel. When the formulation is applied to newly-made parts, a desired surface with excellent mechanical properties would be obtained and thus the service life of the parts would be prolonged greatly. When the formulation is applied to working friction pairs, it would in situ repair the worn surfaces, optimize gaps, recover the designed dimension of parts, prolong the service life of machine, and lower maintenance cost.

SPECIFIC MODELS FOR CARRYING OUT THE PRESENT INVENTION

Figure 1:
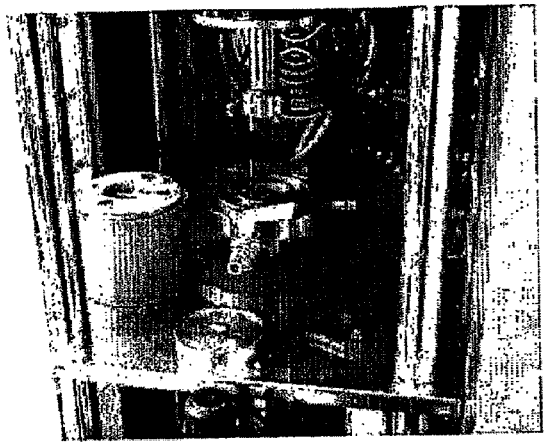
FIG. 1: Photos of (a) test specimen assembly on Falex Tribotester, and (b) the test specimen's draft.
Figure 1:
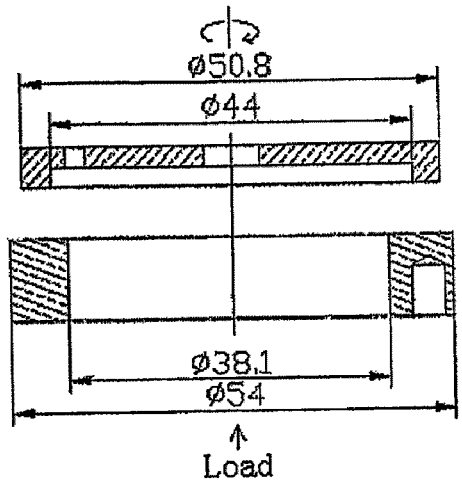

The action mechanism of the formulation for generating a protective layer on a metal surface is as follows.

1) Oxidative Mechanical Polishing

During a frictional process, the powder of natural lamellar hydroxyl silicate ore as the main component of the formulation is readily cleaved and broken, and releases hydroxyl group and $O^{2-}$ to form active free water. The third body particles generated by cleaving and breaking the powder mechanically polish the friction surfaces, and the active $O^{2-}$ and free water oxidize surface asperities to generate metal oxides/metal bonds far weaker than metal bonds thereby performing oxidative polishing to the frictional surfaces. Thus, the oxidative mechanical polishing is the first action to form a nanometer protective layer on the surfaces of friction pairs. Serpentine with $Mg_6Si_4O_{10}(OH)_8$ as main component is used as an example and its action process is shown as follows.

$$Mg_6Si_4O_{10}(OH)_8 \rightarrow 6Mg^{2+}+4SiO_2+4H_2O+6O^{2-}$$

$$Fe^0,Fe^{n+}(EEE)+O^{2-} \rightarrow Fe_xO_y$$

$$Fe^0,Fe^{n+}(EEE)+H_2O+O_2 \rightarrow Fe_x(OH)_y$$

$Fe^0$ (primary surface);

$Fe^{n+}$ (EEE) (Exo-electron emission surface)

2) Lubricant Catalyzing Carbonization and Graphitization

In the friction system containing auto-repairing formulation, iron-based metal friction pairs and the auto-repairing components in lubricant provide a site and catalysis species for carbonization and graphitization of lubricant basic oil. The components include the elements for constituting the most active catalyst for acid/alkali catalytic reactions, and the elements for constituting the most active catalyst for redox reactions. Thus, the lubricant containing auto-repairing formulation has a higher extent of carbonization than akin lubricants, and can generate a large amount of nanometer carbonaceous particles with high activity. The highly active nanometer carbonaceous particles in the oil phase react with ferrites to form $Fe_3C$ phase and graphite particles. Therefore, the carbonization and graphitization of lubricant are the second action mechanism for generating nanometer crystal protective layer on the surfaces of friction pairs. The process of this mechanism is illustrated as follows.

$$Fe_2O_3+C \rightarrow Fe+CO.CO_2$$

$$Fe+C \rightarrow Fe_3C$$

$$Fe_3C \rightarrow Fe\uparrow+C(\text{easy graphitization}) \rightarrow \text{graphite}$$

3) Mechanical Alloying

After the oxidative mechanical polishing and the carbonization of lubrication, the fresh metal surface with high chemical activity and the oil phase containing a large amount of nanometer iron oxides, iron carbides and carbonaceous particles constitute a reaction system for the generation of a repairing and protective layer. The energy released during the friction generates electric field and weak magnetic field on the surfaces of friction pairs, which allow the enriching of the particles in the oil on the surfaces, firstly the aggregation in the surface valley. The movement of surface asperities caused by the relative motion of friction pairs generates shear and pressing stresses on these particles and induces the mechanical alloying thereof. The continue collision of surface asperities renders the surface asperities unstable and also results in the mechanical alloying of the surface asperities. In addition, the nanometer crystal structure layer generated in the valley by mechanical alloying continuously grows to even and repair the surface until the valley are fully filled up and then grows on the whole friction surface to form a repairing and protective layer, thereby achieving the repairing. Thus, the mechanical alloying is the third and final action mechanism for generating nanometer crystal protective layer on the surface of friction pairs.

Elements, Phase Structures and Mechanical Properties of Nanometer Crystal Protective Layer Falex-1506 Tribotester (Falex Company, USA) and test specimens in ring/ring plane contact manner are used. FIG. 1 gives a photo of the test specimen assembly on Falex Tribotester and a specimen's draft showing the dimensions of the specimens. The contact area between the upper and lower specimens is 506 $mm^2$. The test load is ranged from 0.1 MPa to 0.44 MPa, and the average linear speed is 1-7 m/s.

Figure 2:
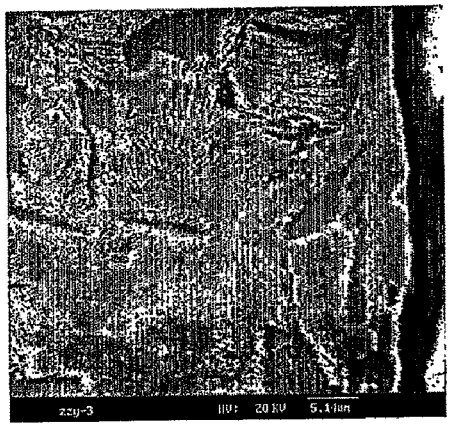
FIG. 2: Protective layer formed on 45# steel substrate.
Figure 3:
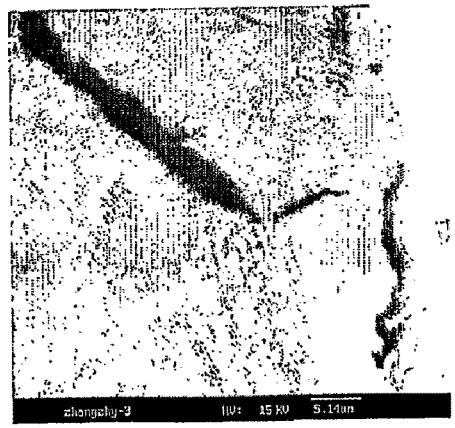
FIG. 3: Protective layer formed on cast iron substrate.

FIG. 2 and FIG. 3 show the protective layers generated on $45^{\#}$ steel and cast iron substrates subjected to Falex testing for 400 and 80 hours, respectively. The main components of the repairing formulation are powders of serpentine ($Mg_6Si_4O_{10}(OH)_8$) and sepiolite ($Mg_8Si_{12}O_{30}(OH)_4(OH_2)_4.8H_2O$). The used lubricant is a blend of API SD/CC SAE 15W-40 engine oil containing the repairing formulation, the amount of the repairing formulation is 5 wt ‰, and oil-immerging lubrication is adopted.

Figure 4:
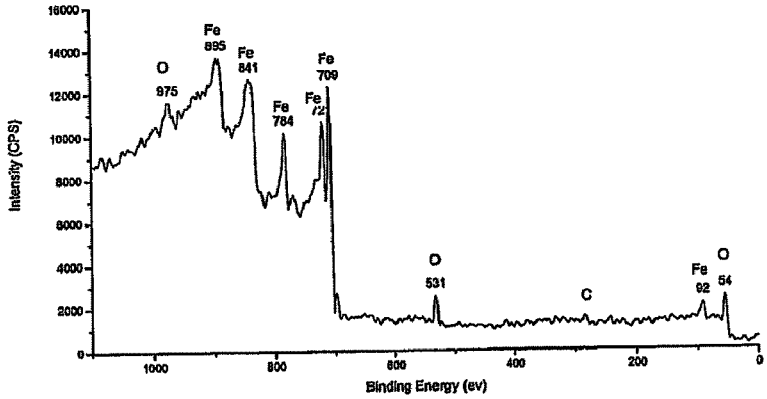
FIG. 4: XPS survey spectrum of element distribution of protective layer.
Figure 5:
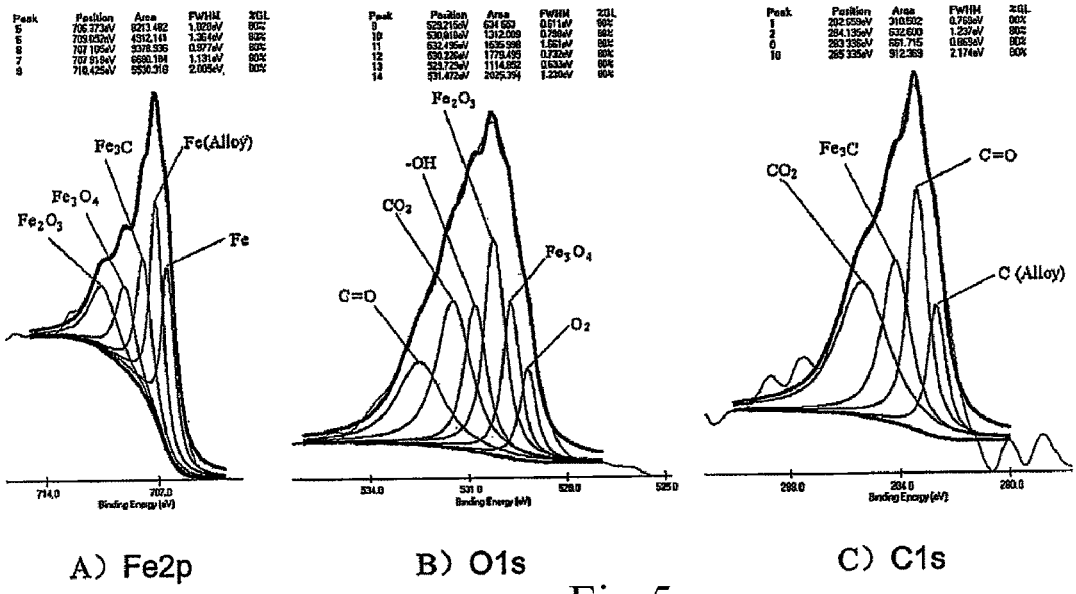
FIG. 5: XPS fine spectrum analyses of element distribution of protective layer.
Figure 6:
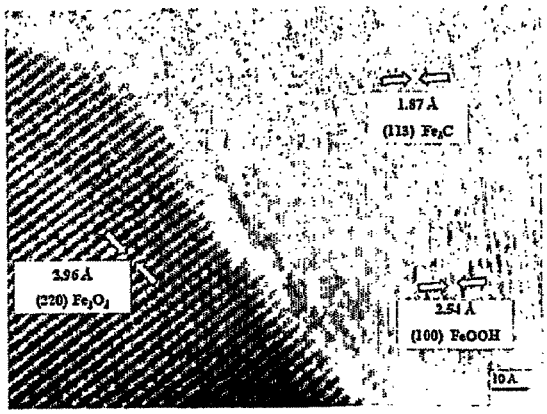
FIG. 6: HRTEM image of the entire crystal system of protective layer.

The X-ray photoelectron spectroscopy (XPS) analyses of the protective layer, as shown in FIG. 4, indicate that Fe, C and O are the main elements constituting the protective layer. From the XPS fine spectrum analyses of the protective layers, as shown in FIG. 5, the valence states of elements indicate that these three elements mainly exist in the forms of $Fe_3C$, $Fe_3O_4$, $Fe_2O_3$, as well as —OH and other Fe, C alloys. FIG. 6 displays the high-resolution transmission electron microscopy (HRTEM) image of the intact crystal system in the protective layer, from which three kinds of nanometer crystals, i.e., $Fe_3C$, $Fe_3O_4$ and FeOOH, could be clearly discerned.

Figure 7:
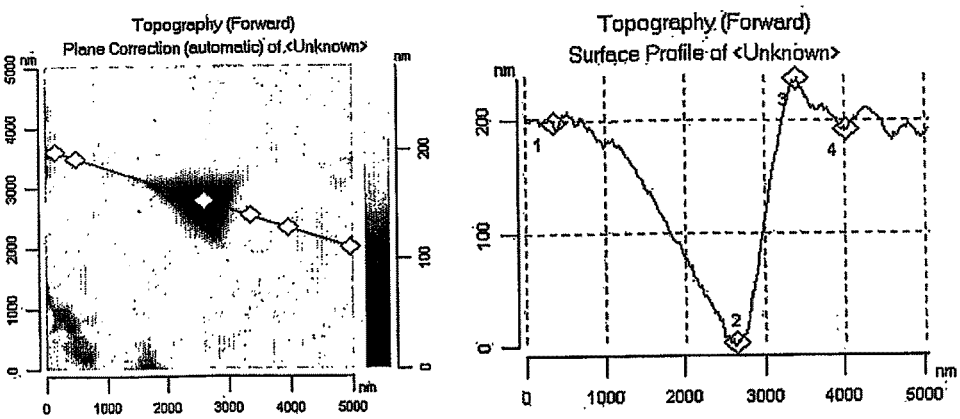
FIG. 7: AFM image and depth curve of nano-hardness indentation on 45# steel protective layer.
Figure 8:
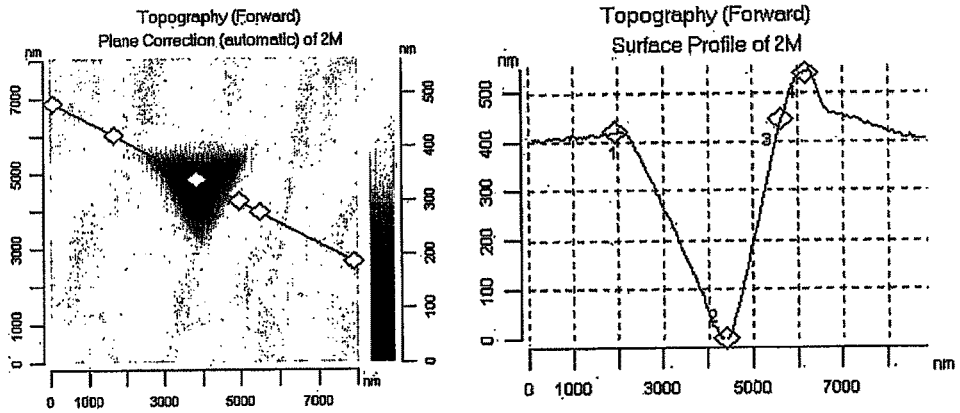
FIG. 8: AFM image and depth curve of nano-hardness indentation on 45# steel substrate.

Table 1 shows the comparison of surface micro-hardness of the $45^{\#}$ steel lower specimen before and after testing, and Table 2 shows the comparison of cross section nano-hardness between the substrate and the protective layer of the $45^{\#}$ steel lower specimen. It can be seen that the surface micro-hardness and the cross section nano-hardness of the protective layer are greatly elevated by 2.6 times of the surface hardness of $45^{\#}$ steel and 3.6 times of the substrate hardness of $45^{\#}$ steel, respectively. The AFM images and the depth curves of the representative nano-hardness indentations on the protective layer and the $45^{\#}$ steel substrate are shown in FIG. 7 and FIG. 8. The values of hardness and elastic modulus of the protective layer are H=13.32 GPa and E=240 Gpa, respectively, and the H/E ratio is about 0.0555, demonstrating that the protective layer has a high "ceramic" hardness and still retains the elastic modulus of super alloy steel.

Figure 9:
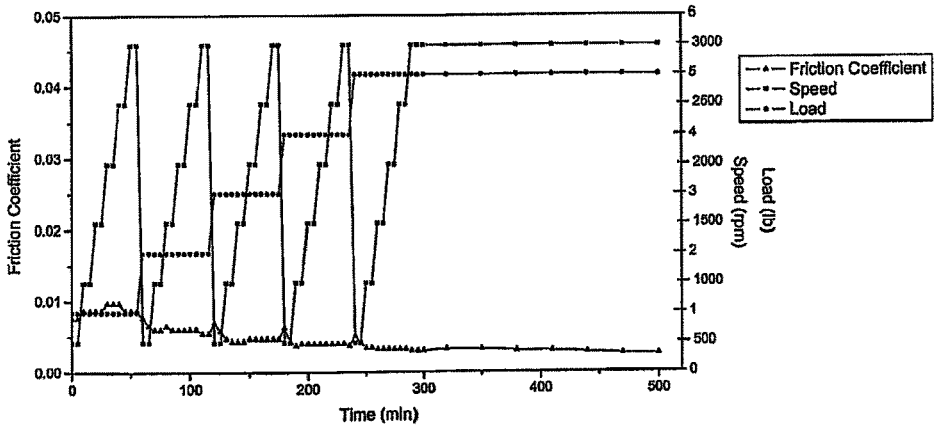
FIG. 9: Curve of friction coefficient under boundary lubrication.

All used lubricant is drained out from the oil cup after 80 hours of the Falex test to allow the lower and upper specimens under boundary lubricating condition. Falex test is then restarted according to the standard schedule and the change of friction coefficient is recorded. The curve of the recorded friction coefficients as shown in FIG. 9 indicates that the friction coefficient keeps always below 0.005 after the running-in period in which the load and speed increase gradually. This demonstrates that the nanometer crystal protective layer possesses a super lubricity.

TABLE 1

Comparison of surface micro-hardness of $45^{\#}$ steel lower specimen before and after Falex test

| Measurement positions | | 1 | 2 | 3 | 4 | 5 | 6 | 7 | 8 | Average |
|---|---|---|---|---|---|---|---|---|---|---|
| Micro-hardness $Hv_{100\,g}$ | Before test | 234 | 290 | 301 | 299 | 290 | 321 | 331 | 321 | 298 |
| | After test | 970 | 707 | 757 | 734 | 748 | 720 | 864 | 738 | 780 |

TABLE 2

Comparison of nano-hardness between the protective layer and the substrate of $45^{\#}$ steel lower specimen after Falex test

| Measurement positions | | 1 | 2 | 3 | 4 | Average |
|---|---|---|---|---|---|---|
| Nano-hardness $Hv_{20\,mN}$ | Substrate | 353.30 | 321.20 | 338.18 | 387.44 | 350.03 |
| | Protective layer | 1177.06 | 1389.45 | 1383.45 | 1149.85 | 1274.95 |

Anti-abrasion and Anti-seizure Properties of the Protective Layer

Figure 10:
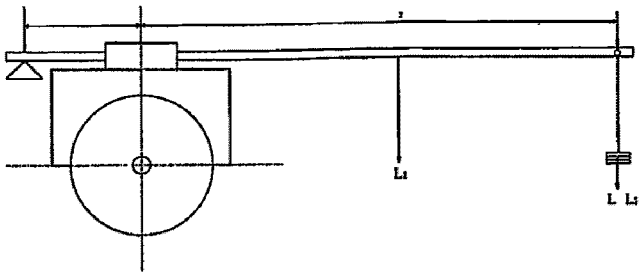
FIG. 10: Principle sketch of the constructed bearing tester.

The test for confirming the generation of protective layer and its anti-abrasion and anti-seizure properties was conducted on a simulated test rig of Journal Bearing of Horizontal Shaft Type Pump. The shaft specimen and the bearing specimen were made of $45^{\#}$ steel and Babbitt alloy, respectively. The principle sketch of the constructed bearing tester is shown in FIG. 10. The lever ratio is 1:10, $L_1$ stands for load weight, and the dead weight of lever and weight pallet is: $L_2+L_3$=0.912 kg. The surface roughness of the bearing specimen is Ra=0.3692 μm, the thickness of alloy layer is 2 mm, and the bearing diameter and width are 120 mm and 10 mm, respectively. The surface roughness of the shaft specimen is Ra=0.5359 μm, and the shaft diameter and width are 120 mm and 15 mm, respectively. The lubricant is a blend of API SD/CC SAE 15W-40 engine oil containing the repairing formulation. The main components of the repairing formulation are powders of serpentine ($Mg_6Si_4O_{10}(OH)_8$) and sepiolite ($Mg_8Si_{12}O_{30}(OH)_4(OH_2)_4.8H_2O$). The amount of the repairing formulation is 5 wt ‰, and the oil-immerging lubrication manner is adopted. The test parameters are listed in Table 3.

TABLE 3

| Bearing simulation test parameters | | |
|---|---|---|
| Test Period | Running in | Normal test |
| Normal Load on bearing surface (N) | 18.74 | 38.34 |
| Average bearing pressure (MPa) | 0.33 | 0.70 |
| Rotation speed (rpm) | 1800 | 1800 |
| Average line speed (m/sec) | 11.3 | 11.3 |
| Temperature (° C.) | Room | Room |
| Test Time (h) | 3 | 24 |

1) Surface Topography and SEM of the Protective Layer

Figure 11:
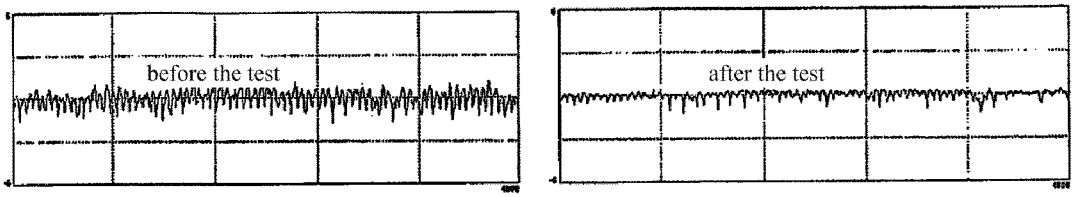
FIG. 11: Surface topographys of 45# steel shaft specimen before and after bearing test.

After friction test, the average surface roughness of 45# steel shaft is Ra=0.3859 μm, less than the original surface roughness Ra=0.5359 μm. Similarly, the average surface roughness of the bearing is Ra=0.2605 μm, less than the original surface roughness Ra=0.3692 μm. FIG. 11 shows the typical 2D surface topography images of the shaft specimen before and after test.

Figure 12:
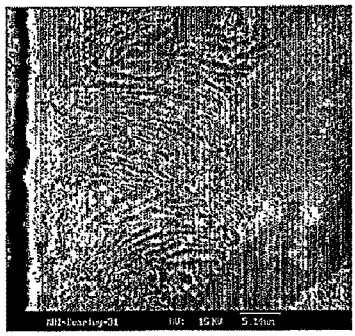
FIG. 12: SEM image of cross section of 45# steel shaft specimen after bearing test.
Figure 13:
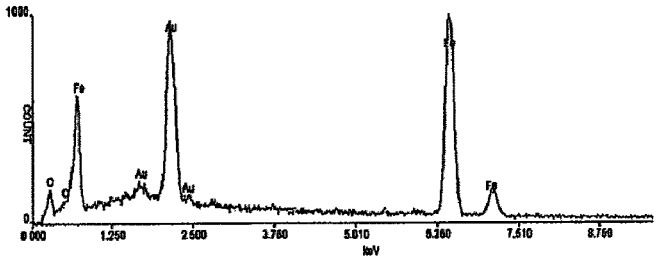
FIG. 13: EDX spectrum of protective layer on 45# steel specimen after bearing test.

FIG. 12 shows the SEM secondary electronic image of the cross section of 45# steel shaft after a 27-hour bearing test. It is clearly seen that the protective layer of about 2 μm thickness has been formed on the friction surface of 45# steel, in which the protective layer grows along the pearlite skeleton of substrate and adheres closely to the substrate without a clearly distinguishable physical boundary. FIG. 13 shows the EDX spectra of the protective layer, which clearly indicates that the protective layer consists of three elements, i.e., Fe, C and O. The C content in the protective layer is much higher than that in 45# steel due to the generation of C element by pyrolysis of carrier oil in lubricant. The O content in the protective layer is also very high which is derived from the cleavage fracture of serpentine ($Mg_6Si_4O_{10}(OH)_8$) and talc ($Mg_3(Si_4O_{10})(OH)_2$).

Figure 14:
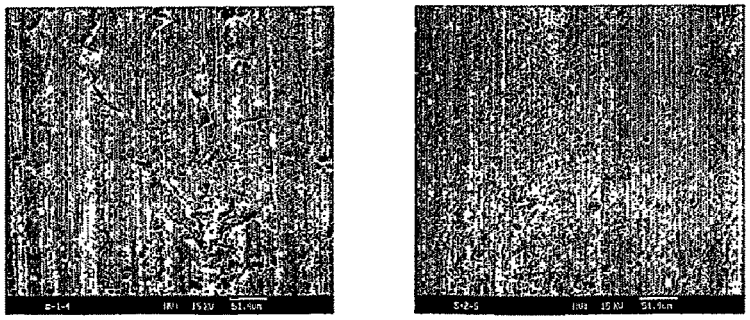
FIG. 14: SEM images of 45# steel surfaces without (a) and with (b) protective layer after abrasive test.

2) Anti-abrasion Property of the Protective Layer 400 mg 100~125 μm corundum ($Al_2O_3$) powder is admixed with 3.3 g SiC abrasive paste (trademark is W.15, and the SiC particle size is 1~1.5 μm) to obtain an abrasive material. The abrasive material is added into SD/CC SAE 15W-40 oil without the repairing formulation, and the anti-abrasion test is conducted on the simulated bearing test rig. The test load is W=38.34N; the average surface pressure is P=0.70 MPa; the rotation speed is n=2100 rpm; the total test time is Tt=4.5 hours; and the oil-immerging lubrication is adopted. FIG. 14 gives the SEM secondary electronic images of 45# steel shaft surfaces after the anti-abrasion test, in which a) is the image of the shaft surface without the protective layer, and b) is the image of the shaft surface with the protective layer. Obviously, the shaft surface without the protective layer exhibits much severe defeature than the shaft surface with the protective layer. The wear scar depths measured by Talysurf-5 Profilometer indicate that the depths of abrasive wear scars on the surface without and with the protective layer are 46.59 μm and 15.01 μm, respectively. The wear volume of the former is three times larger than that of the later.

3) Anti-seizure Property of the Protective Layer

Figure 15:
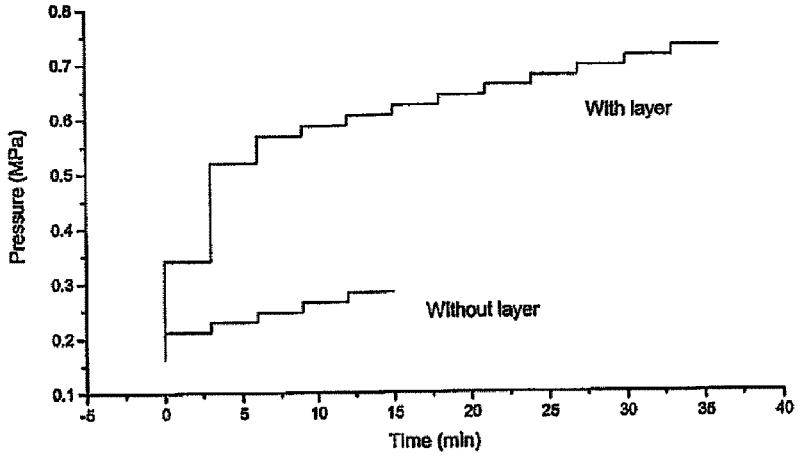
FIG. 15: Carrying capacity curves of friction pairs with and without protective layer on 45# steel surface.
Figure 16:
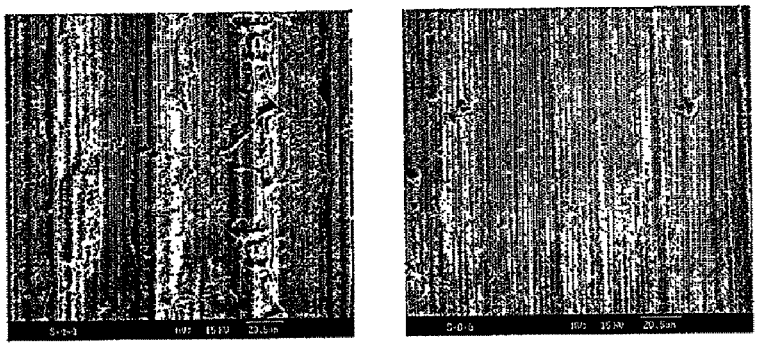
FIG. 16: SEM images of 45# steel surfaces without (a) and with (b) protective layer after seizure resistance test.

The anti-seizure test is conducted on the simulated bearing test rig. API SD/CC SAE 15W-40 engine oil without the repairing formulation is used under oil starvation condition. After running-in, the test conditions are kept, and the load is gradually increased step by step per 3 minutes until seizure occurs. FIG. 15 shows the carrying capacity curves of friction pairs with and without protective layer until seizure occurring. Obviously, the seizure resistance of the friction pairs with the protective layer is about 2.5 times higher than that without the layer. FIG. 16 gives the SEM secondary electronic images of 45# steel shaft surfaces after the anti-seizure test, in which a) is the image of the shaft surface without the protective layer, and b) is the image of the shaft surface with the protective layer. Obviously, the shaft surface without the protective layer exhibits much severe defeature than the shaft surface with the protective layer.

EXAMPLE 1

The formulation used in Example 1 is as follows (weight parts):

| | |
|---|---|
| Serpentine ($Mg_6Si_4O_{10}(OH)_8$) | 99; |
| NDZ-131 mono-alkoxy fatty-acid titanate coupling agent | 12; |
| Nanometer Ni catalyst for carbonization and graphitization | 1; |
| Nanometer Co catalyst for carbonization and graphitization | 1. |

Serpentine and NDZ-131 mono-alkoxy fatty-acid titanate coupling agent were ground together in a high-energy ball mill (XQM2 type Planetary High-Energy Ball Mill) for 10 hours at 800 rpm until the particle-diameter was between 10 nm and 1 μm. Then the powdery nanometer Ni and Co catalysts for carbonization and graphitization (produced by Gaosida Nanometer Material Apparatus Co., Ltd., Siping City, Jilin Province) were added and continuously ground for 30 min to obtain a formulation with auto-repairing function useful in lubricants.

The obtained formulation was added in a mass ratio of 0.5‰ to a lubricant (ZZT-Kinetic Oil (Miaomei), Bolingaoke (Beijing) Petrochemical Co., Ltd.), and the obtained lubricant was compared with a SF level gasoline engine oil in a Jetta automotive engine in terms of fuel consumption and emission. The conditions were as follows.

1. Test car: 4 cylinders engine with a displacement of 1.6 L equipped with ternary catalyst; the cylinder pressure was about 8.2 after over 130,000 kilometer driving.
2. Basic data of fuel consumption and emission were obtained after the car loading with the SF level gasoline engine oil ran for 200 km strictly in accordance with test specification; the cylinder pressure has never been improved.
3. After replacing the SF level gasoline engine oil with ZZT-Kinetic Oil (Miaomei) lubricant containing the formulation, the following comparative data was collected over 2000 km driving period:

1) The cylinder pressure was recovered to the original level of 12;

2) Energy saving data: the overall fuel saving rates were: 3.1% (urban district at a speed of 30-50 km/h); 3.3% (intercity at a speed of 70-90 km/h); and 3.7% (express way at a speed of about 110 km/h).

3) Emission data:

| | SF level gasoline engine oil | ZZT-Kinetic Oil (Miaomei) lubricant |
|---|---|---|
| HC + NO*x* | 0.180 | 0.138 |
| CO | 0.74 | 0.563 |

EXAMPLE 2

The formulation used in Example 2 is as follows (weight parts):

| | |
|---|---|
| Serpentine ($Mg_6Si_4O_{10}(OH)_8$) | 50; |
| Talc ($Mg_3(Si_4O_{10})(OH)_2$) | 25 |
| NDZ-133 mono-alkoxy fatty-acid titanate coupling agent | 12; |
| Nanometer PdO catalyst for carbonization and graphitization | 0.5; |
| Nanometer Pt catalyst for carbonization and graphitization | 0.5. |

Serpentine and talc particles and NDZ-133 mono-alkoxy fatty-acid titanate coupling agent were ground together in a high-energy ball mill for 10 hours at 800 rpm until the particle-diameter was between 10 nm and 1 μm. Then powdery nanometer PdO and Pt catalysts for carbonization and graphitization were added and continuously ground for 30 min obtain a formulation with auto-repairing function useful in lubricants.

The obtained formulation was added in a mass ratio of 1‰ to API SD/CC SAE 15W-40 engine oil. The test was conducted on a simulated test rig of Journal Bearing of Horizontal Shaft Type Pump. The shaft specimen and the bearing specimen were made of 45# steel and Babbitt alloy respectively. The principle sketch of the constructed bearing tester is shown in FIG. 10. FIG. 12 shows the SEM secondary electronic image of the cross section of 45# steel shaft after a 27-hour bearing test. It is clearly seen that the protective layer of about 2 μm thickness has been formed which grows along the pearlite skeleton of substrate and adheres closely to the substrate without a clearly distinguishable physical boundary. FIG. 13 shows the EDX spectra of the protective layer indicating that the layer consists of Fe, C and O elements. The protective layer exhibits excellent anti-abrasion and anti-seizure properties as shown in FIG. 14-16.

EXAMPLE 3

The formulation used in Example 3 is as follows (weight parts):

| | |
|---|---|
| Serpentine ($Mg_6Si_4O_{10}(OH)_8$) | 70; |
| Sepiolite ($Mg_8Si_{12}O_{30}(OH)_4(OH_2)_4 \cdot 8H_2O$) | 29 |
| HD-22 silane coupling agent | 7; |
| $RhCl_3$ catalyst for carbonization and graphitization | 1; |
| $RuO_2$ catalyst for carbonization and graphitization | 1. |

Serpentine and sepiolite particles and HD-22 silane coupling agent were ground together in a high-energy ball mill for 10 hours at 800 rpm, until the particle-diameter was between 10 nm and 1 μm. Then powdery $RhCl_3$ and $RuO_2$ catalyst for carbonization and graphitization were added and continuously ground for 30 min to obtain a formulation with auto-repairing function useful in lubricants.

The obtained formulation was admixed in a mass ratio of 5‰ to API SD/CC SAE 15W-40 engine oil. The surface contact friction test was conducted on a Falex Tribotester. 45# steel and cast iron were used as materials for two specimens, and oil-immerging lubrication was adopted. The test time for 45# friction pairs was 400 hours, and the test time for the cast iron was 80 hours. SEM results confirmed that protective layers were formed on both 45# steel and cast iron specimens as shown in FIG. 2 and FIG. 3, respectively. The protective layers were further analyzed by XPS, nano-indentor, AFM, and HRTEM. The results indicated that the protective layer was constituted with three elements: Fe, C and O, which mainly existed in forms of $Fe_3C$, $Fe_3O_4$, $Fe_2O_3$, as well as —OH and other alloy forms of Fe and C and formed nanometer crystal system as shown in FIGS. 4, 5 and 6. The protective layer exhibits a high "ceramic" hardness and still retains the elastic properties of super alloy steel as well as excellent tribological property of superlubricity, as shown in FIGS. 7, 8 and 9.

EXAMPLE 4

The formulation used in Example 4 is as follows (weight parts):

| | |
|---|---|
| Serpentine ($Mg_6Si_4O_{10}(OH)_8$) | 50; |
| Actinolite ($Ca_2(Mg, Fe)_5Si_8O_{22}(OH)_2$) | 25 |
| HD-22 silane coupling agent | 7; |
| Nanometer Ni catalyst for carbonization and graphitization | 1; |
| Nanometer Fe catalyst for carbonization and graphitization | 1. |

Serpentine and actinolite particles and HD-22 silane coupling agent were ground together in a high-energy ball mill for 10 hours at 800 rpm, until the particle-diameter was between 10 nm and 1 μm. Then powdery Ni and Fe catalysts for carbonization and graphitization were added and continuously ground for 30 min to obtain a formulation with auto-repairing function useful in lubricants.

Figure 17:
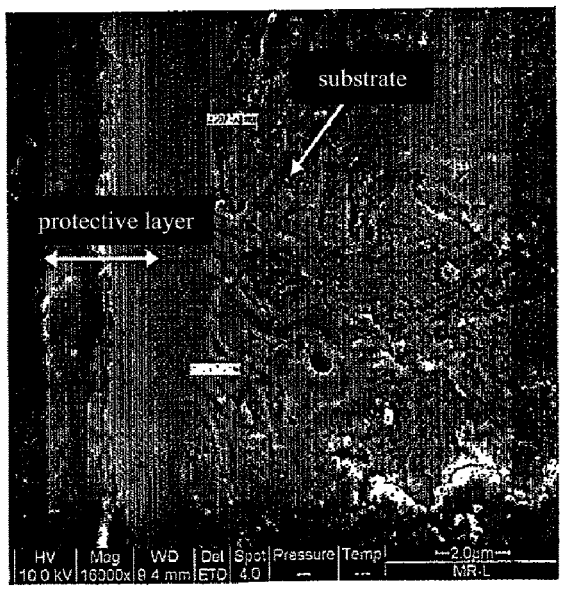
FIG. 17: SEM image of cross section of lower specimen after Falex test in Example 4.
Figure 18:
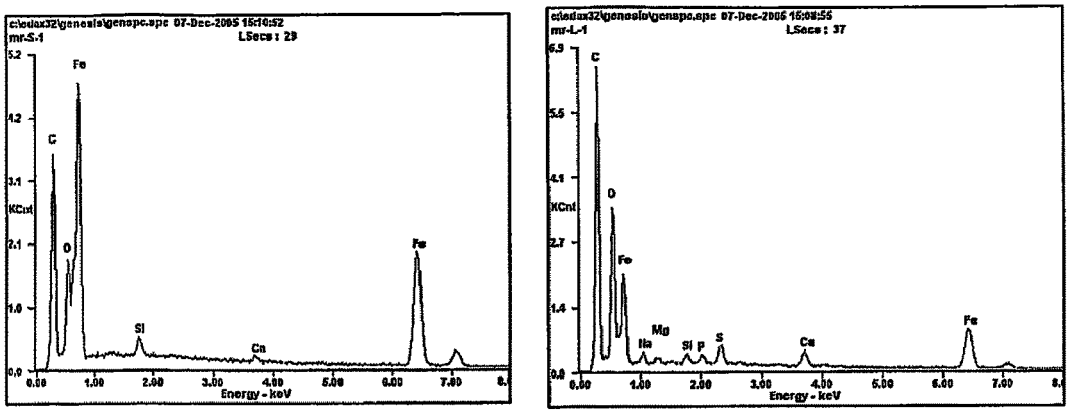
FIG. 18: EDX results of substrate (a) and protective layer (b) in Example 4.

The obtained formulation was added in a mass ratio of 3‰ to API SD/CC SAE 15W-40 engine oil. The surface contact friction test was conducted on a Falex Tribotester. The test specimen was of cast iron, and oil-immerging lubrication was adopted. The test was performed for 4 cycles, 24-hour for each cycle, i.e., totaling 96 hours. FIG. 17 is SEM image of the cross section of the lower specimen after Falex test, which shows that the protective layer is about 2-3 μm thick on the substrate surface with a microstructure quite different from the substrate. FIG. 18 gives the EDX spectra of the protective layer and the cast iron substrate, which indicate that the element distribution of the protective layer characterizes in a significant increase of both C content and O content in comparison with the substrate. The Fe/C of substrate is 0.43 in comparison with 0.14 in the protective layer.

EXAMPLE 5

The formulation used in Example 5 is as follows (weight parts):

| | |
|---|---|
| Serpentine ($Mg_6Si_4O_{10}(OH)_8$) | 75; |
| NDZ-133 mono-alkoxy fatty-acid titanate coupling agent | 6; |
| NDZ-131 mono-alkoxy fatty-acid titanate coupling agent | 6; |
| $IrO_2$ catalyst for carbonization and graphitization | 2. |

Serpentine particles and NDZ-133 and NDZ-131 coupling agents were ground together in a high-energy ball mill for 10 hours at 800 rpm, until the particle-diameter was between 10 nm and 1 μm. Then powdery $IrO_2$ catalyst for carbonization and graphitization were added and continuously ground for 30 min to obtain a formulation with auto-repairing function useful in lubricants.

Figure 19:
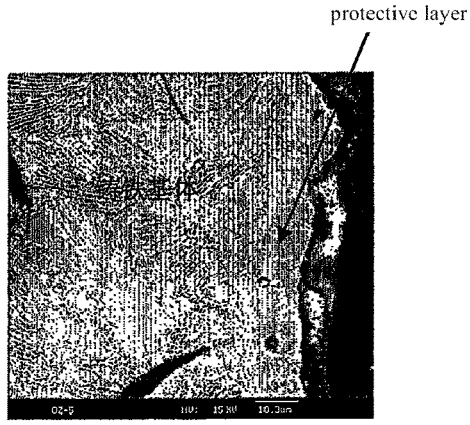
FIG. 19: SEM image of cross section of lower specimen after Falex test in Example 5.

The obtained formulation was added in a mass ratio of 5‰ to API SD/CC SAE 15W-40 engine oil, and the surface contact friction test was conducted on a Falex Tribotester. The test specimen was of cast iron, and oil-immerging lubrication was adopted. The test was performed for 7 cycles, 24 hours for each cycle, totaling 148 hours. FIG. 19 is the SEM of the cross section of the lower specimen, which shows that the protective layer of about 3 μm thickness formed on the specimen surface. The average nano-hardness values of the cast iron substrate and the protective layer were $Hv_{20mN}$=572 and $Hv_{20mN}$=1158, respectively.

EXAMPLE 6

The formulation used in Example 6 is as follows (weight parts):

| | |
|---|---|
| Talc ($Mg_3(Si_4O_{10})(OH)_2$) | 99; |
| HD-22 silane coupling agent | 10; |
| NDZ-131 mono-alkoxy fatty-acid titanate coupling agent | 10; |
| RuCl catalyst for graphitization | 3. |

Talc particles and HD-22 and NDZ-131 coupling agents were ground together in a high-energy ball mill for 10 hours at 800 rpm, until the particle-diameter was between 10 nm and 1 μm. Then powdery RuCl catalyst for graphitization was added and continuously ground for 30 min to obtain a formulation with auto-repairing function useful in lubricants.

Figure 20:
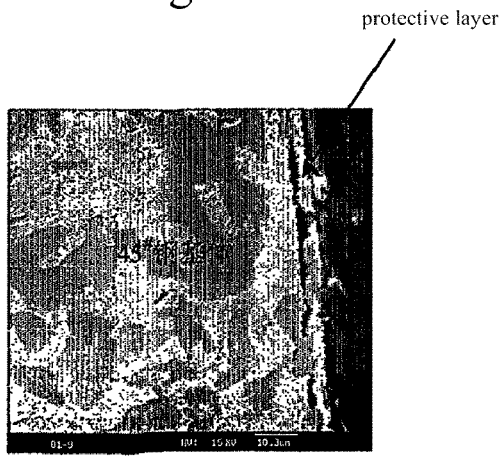
FIG. 20: SEM image of cross section of lower specimen after Falex test in Example 6.

The obtained formulation was added in a mass ratio of 3.5‰ to API SD/CC SAE 15W-40 engine oil, and the surface contact friction test was conducted on a Falex Tribotester. The test specimen was of 45# steel, and oil-immerging lubrication was adopted. The test was performed for 6 cycles, 24 hours for each cycle, totaling 144 hours. FIG. 20 is the SEM image of the cross section of the lower specimen, which shows that the protective layer of about 2 μm thickness was formed on the surface. The surface micro-hardness of the lower specimen was increased from the original level of $Hv_{100g}$=298 to a level of $Hv_{100g}$=785 after the Falex test.

EXAMPLE 7

The formulation used in Example 7 is as follows (weight parts):

| | |
|---|---|
| Sepiolite ($Mg_8Si_{12}O_{30}(OH)_4(OH_2)_4 \cdot 8H_2O$) | 60; |
| NDZ-131 mono-alkoxy fatty-acid titanate coupling agent | 3; |
| Nanometer Ni catalyst for carbonization and graphitization | 0.025; |
| Nanometer Co catalyst for carbonization and graphitization | 0.025. |

Sepiolite particles and NDZ-131 coupling agent were ground together in a high-energy ball mill for 10 hours at 800 rpm, until the particle-diameter was between 10 nm and 1 μm. Then powdery Ni and Co catalysts for carbonization and graphitization were added and continuously ground for 30 min to obtain a formulation with auto-repairing function useful in lubricants.

The obtained formulation was added in a mass ratio of 5‰ to API SD/CC SAE 15W-40 engine oil, and the surface contact friction test was conducted on a Falex Tribotester. The test specimen was of 45# steel, and oil-immerging lubrication was adopted. The test was performed for 4 cycles, 24 hours for each cycle, totaling 96 hours. The surface micro-hardness of the lower specimen was increased from the original level of $Hv_{100g}$=275 to a level of $Hv_{100g}$=750 after the Falex test. The SEM image of the cross section of the lower specimen shows that the protective layer is about 0.5-1 μm thick on the surface.

EXAMPLE 8

The formulation used in the Example 8 is as follows (weight parts):

| | |
|---|---|
| Actinolite ($Ca_2(Mg, Fe)_5Si_8O_{22}(OH)_2$) | 60 |
| HD-22 silane coupling agent | 20; |
| Nanometer Fe catalyst for carbonization and graphitization | 3. |

Actinolite particles and HD-22 silane coupling agent were ground together in a high-energy ball mill for 10 hours at 800 rpm, until the particle-diameter was between 10 nm and 1 μm. Then powdery Fe catalyst for carbonization and graphitization was added and continuously ground for 30 min to obtain a formulation with auto-repairing function useful in lubricants.

The obtained formulation was added in a mass ratio of 4‰ to API SD/CC SAE 15W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The SEM image of the cross section of the lower specimen shows that the protective layer is about 1 μm thick on the surface. The surface micro-hardness of the lower specimen was increased from the original level of $Hv_{100g}$=298 to a level of $Hv_{100g}$=780 after the Falex test.

EXAMPLE 9

The formulation used in Example 9 is as follows (weight parts):

| | |
|---|---|
| Serpentine ($Mg_6Si_4O_{10}(OH)_8$) | 50; |
| Talc ($Mg_3(Si_4O_{10})(OH)_2$ | 49 |
| NDZ-133 mono-alkoxy fatty-acid titanate coupling agent | 50; |
| Nanometer Ni catalyst for carbonization and graphitization | 1.5; |
| $RuO_2$ compound catalyst for carbonization and graphitization | 1.5; |

Serpentine and talc particles and NDZ-133 coupling agent were ground together in a high-energy ball mill for 10 hours at 800 rpm, until the particle-diameter was between 10 nm and 1 μm. Then powdery nanometer Ni and $RuO_2$ catalysts for carbonization and graphitization were added and continuously ground for 30 min to obtain a formulation with auto-repairing function useful in lubricants.

The obtained formulation was added in a mass ratio of 3.5‰ to API SD/CC SAE 15W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The SEM of the cross section of lower specimen shows that the protective layer is about 1 μm thick on the surface. The surface micro-hardness of the lower specimen was increased from the original level of $Hv_{100g}$=275 to $Hv_{100g}$=710 after the Falex test.

EXAMPLE 10

The formulation used in Example 10 is as follows (weight parts):

| | |
|---|---|
| Serpentine ($Mg_6Si_4O_{10}(OH)_8$) | 35; |
| Sepiolite ($Mg_8Si_{12}O_{30}(OH)_4(OH_2)_4 \bullet 8H_2O$) | 10 |
| HD-22 silane coupling agent | 1; |
| $RhCl_3$ catalyst for carbonization and graphitization | 0.025; |
| $RuO_2$ catalyst for carbonization and graphitization | 0.025. |

Serpentine and sepiolite particles and HD-22 silane coupling agent were ground together in a high-energy ball mill for 10 hours at 800 rpm, until the particle-diameter was between 10 nm and 1 μm. Then powdery $RhCl_3$ and $RuO_2$ catalyst for carbonization and graphitization were added and continuously ground for 30 min to obtain a formulation with auto-repairing function useful in lubricants.

The obtained formulation was added in a mass ratio of 5‰ to API SD/CC SAE 15W-40 engine oil, and the surface contact friction test was conducted on a Falex Tribotester. The test specimen was of 45# steel adopting immerging lubrication. The test was performed for 5 cycles, 24 hours for each cycle, totaling 120 hours. The SEM image of the cross section of the lower specimen shows that the protective layer is about 1 μm thick on the surface. The surface micro-hardness of the lower specimen was increased from the original level of $Hv_{100g}$=256 to a level of $Hv_{100g}$=720 after the Falex test.

EXAMPLE 11

The formulation used in Example 11 is as follows (weight parts):

| | |
|---|---|
| Serpentine ($Mg_6Si_4O_{10}(OH)_8$) | 40; |
| Talc ($Mg_3(Si_4O_{10})(OH)_2$ | 20 |
| NDZ-133 mono-alkoxy fatty-acid titanate coupling agent | 20; |
| Nanometer Ni catalyst for carbonization and graphitization | 0.025; |
| $IrCl_3$ compound catalyst for carbonization and graphitization | 0.025. |

Serpentine and talc particles and NDZ-133 coupling agent were ground together in a high-energy ball mill for 10 hours at 800 rpm, until the particle-diameter was between 10 nm and 1 μm. Then powdery Nanometer Ni and $IrCl_3$ catalysts for carbonization and graphitization were added and continuously ground for 30 min to obtain a formulation with auto-repairing function useful in lubricants.

The obtained formulation was add in a mass ratio of 3.5‰ to API SD/CC SAE 15W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The SEM image of the cross section of the lower specimen shows that the protective layer is about 1 μm thick on the surface. The surface micro-hardness of the lower specimen was increased from the original level of $Hv_{100g}$=245 to $Hv_{100g}$=685 after the Falex test.

EXAMPLE 12

The formulation used in Example 12 is as follows (weight parts):

| | |
|---|---|
| Serpentine ($Mg_6Si_4O_{10}(OH)_8$) | 45; |
| NDZ-133 mono-alkoxy fatty-acid titanate coupling agent | 25; |
| NDZ-131 mono-alkoxy fatty-acid titanate coupling agent | 25; |
| Nanometer Ni catalyst for carbonization and graphitization | 6. |

Serpentine particles and NDZ-133 and NDZ-131 coupling agents were ground together in a high-energy ball mill for 10 hours at 800 rpm, until the particle-diameter was between 10 nm and 1 μm. Then powdery nanometer Ni catalyst for carbonization and graphitization was added and continuously ground for 30 min to obtain a formulation with auto-repairing function useful in lubricants.

The obtained formulation was added in a mass ratio of 5‰ to API SD/CC SAE 15W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The surface micro-hardness of lower specimen was increased from the original level of $Hv_{100g}$=250 to a level of $Hv_{100g}$=670 after the Falex test. The SEM image of the cross section of the lower specimen shows that the protective layer is about 0.5-1 μm thick on the surface.

EXAMPLE 13

The formulation used in Example 13 is as follows (weight parts):

| | |
|---|---|
| Actinolite ($Ca_2(Mg, Fe)_5Si_8O_{22}(OH)_2$) | 45 |
| HD-22 silane coupling agent | 0.5; |
| NDZ-131 mono-alkoxy fatty-acid titanate coupling agent | 0.5; |
| Nanometer Co catalyst for carbonization and graphitization | 3; |
| Nanometer Fe catalyst for carbonization and graphitization | 3. |

Actinolite particles, HD-22 silane coupling agent and NDZ-131 mono-alkoxy fatty-acid titanate coupling agent were ground together in a high-energy ball mill for 10 hours at 800 rpm, until the particle-diameter was between 10 nm and 1 μm. Then powdery Co and Fe catalysts for carbonization and graphitization were added in and went on grinding for 30 min to obtain a formulation with auto-repairing function useful in lubricants.

The obtained formulation was added in a mass ratio of 4‰ to API SD/CC SAE 15W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The SEM image of the cross section of the lower specimen shows that the protective layer is about 1 μm thick on the surface. The surface micro-hardness of the lower specimen was increased from the original level of $Hv_{100g}$=298 to a level of $Hv_{100g}$=780 after the Falex test.

EXAMPLE 14

The formulation used in Example 14 is as follows (weight parts):

| | |
|---|---|
| Serpentine ($Mg_6Si_4O_{10}(OH)_8$) | 50; |
| Talc ($Mg_3(Si_4O_{10})(OH)_2$ | 49; |
| NDZ-133 mono-alkoxy fatty-acid titanate coupling agent | 1; |
| $RuO_2$ catalyst for carbonization and graphitization | 3; |
| $RhCl_3$ compound catalyst for carbonization and graphitization | 3. |

Serpentine and talc particles and NDZ-133 coupling agent were ground together in a high-energy ball mill for 10 hours at 800 rpm, until the particle-diameter was between 10 nm and 1 μm. Then powdery $RuO_2$ and $RhCl_3$ catalyst for carbonization and graphitization were added and continuously ground for 30 min to obtain a formulation with auto-repairing function useful in lubricants.

The obtained formulation was added in a mass ratio of 3.5‰ to API SD/CC SAE 15 W-40 engine oil, and the surface contact friction test was conducted on a Falex Tribotester. The test specimen was of 45# steel adopting immerging lubrication. The test was performed for 4 cycles, 24 hours for each cycle, totaling 96 hours. The SEM image of the cross section of the lower specimen shows that the protective layer is about 1 μm thick on the surface. The surface micro-hardness of the lower specimen was increased from the original level of $Hv_{100g}$=275 to a level of $Hv_{100g}$=710 after the Falex test.

What is claimed is:

1. A formulation for generating a protective layer on a metal surface, consisting of the following components in weight parts:

| | |
|---|---|
| Lamellar hydroxyl silicate powder | 45-99; |
| Surface modifier | 1-50; |
| Catalyst for carbonization and graphitization | 0.05-6. |

2. The formulation for generating a protective layer on a metal surface according to claim 1, consisting of the following components in weight parts:

| | |
|---|---|
| Lamellar hydroxyl silicate powder | 60-99; |
| Surface modifier | 3-20; |
| Catalyst for carbonization and graphitization | 0.05-3. |

3. The formulation for generating a protective layer on a metal surface according to claim 2, consisting of the following components in weight parts:

| | |
|---|---|
| Lamellar hydroxyl silicate powder | 75-99; |
| Surface modifier | 7-12; |
| Catalyst for carbonization and graphitization | 1-2. |

4. The formulation for generating a protective layer on a metal surface according to claim 3, wherein the lamellar hydroxyl silicate powder is a powder of magnesium silicate hydroxide ore.

5. The formulation for generating a protective layer on a metal surface according to claim 4, wherein the powder of magnesium silicate hydroxide ore is one of ore powders of serpentine, talcum, sepiolite and actinolite, or a combination thereof.

6. The formulation for generating a protective layer on a metal surface according to claim 3, wherein the surface modifier is one of titanate coupling agents or silane coupling agents, or a combination thereof.

7. The formulation for generating a protective layer on a metal surface according to claim 3, wherein the catalyst for carbonization and graphitization is one of elementary elements, oxides and chlorides of the elements Fe, Co, Ni, Ru, Rh, Pd, Os, Ir and Pt, or a combination thereof.

8. A method for preparing a formulation for generating a protective layer on a metal surface, the formulation consisting of the following components in weight parts: a lamellar hydroxyl silicate powder (45-99); a surface modifier (1-50); and, a catalyst for carbonization and graphitization (0.05-6), and the method comprising the following: 1) Grinding the lamellar hydroxyl silicate powder with the surface modifier to form an oil-dispersible powder with particles of nanometer to micrometer grade; and 2) Adding the catalyst for carbonization and graphitization and continuously grinding to form a formulation in form of uniform powder.

9. A lubricant including the formulation according to claim 1.

10. A method of using a formulation for generating a protective layer on a metal surface according to claim 8, comprising directly adding the formulation in a mass ratio of 0.1-5% to a lubricant.

11. The method of claim 8, wherein the lamellar hydroxyl silicate powder is a powder of natural magnesium silicate hydroxide ore.

* * * * *